United States Patent [19]

Nierman

[11] 4,258,847

[45] Mar. 31, 1981

[54] NONDEFORMABLE CONTAINER

[76] Inventor: Henri J. M. Nierman, 6 Keistraat, 3512 UV Utrecht, Netherlands

[21] Appl. No.: 59,117

[22] Filed: Jul. 19, 1979

[51] Int. Cl.[3] ..... B65D 1/24; B65D 21/02; B65D 25/28

[52] U.S. Cl. ..... 206/504; 206/509; 220/21; 220/23.4; 220/23.6; 220/94 A

[58] Field of Search ..... 220/23.4, 23.6, 94 A, 220/21; 206/504, 509, 511, 423; 211/74, 194; 312/107, 108, 111, 117; D7/71; D9/179, 182, 183; 215/10; 229/22

[56] References Cited

U.S. PATENT DOCUMENTS

| | | | |
|---|---|---|---|
| 1,599,967 | 9/1926 | Johnson | 229/94 A |
| 2,358,523 | 9/1944 | McKinley | 229/22 X |
| 2,994,450 | 8/1961 | De Van et al. | 217/65 X |
| 3,052,368 | 9/1962 | Atkins et al. | 215/10 |
| 3,425,586 | 2/1969 | Petters et al. | 220/23.4 |
| 3,435,982 | 4/1969 | Sneed | 220/94 A X |
| 3,444,991 | 5/1969 | Raybois | 220/67 X |
| 3,643,812 | 2/1972 | Mander et al. | 206/443 X |
| 3,767,104 | 10/1973 | Bachman et al. | 206/423 X |
| 3,908,852 | 9/1975 | Ricobent | 220/23.6 X |

FOREIGN PATENT DOCUMENTS

| | | | |
|---|---|---|---|
| 1467849 | 2/1967 | France | 211/74 |
| 2235839 | 1/1975 | France | 220/23.4 |

*Primary Examiner*—Allan N. Shoap
*Attorney, Agent, or Firm*—Blanchard, Flynn, Thiel, Boutell & Tanis

[57] ABSTRACT

A container provided with a partition forming compartments for accommodating wine bottles.

The container has a triangular cross section and two adjoining side walls are provided with a step directed towards the corner between the side walls.

A handle for carrying the container is formed by an opening in said step.

8 Claims, 3 Drawing Figures

Fig: 1.
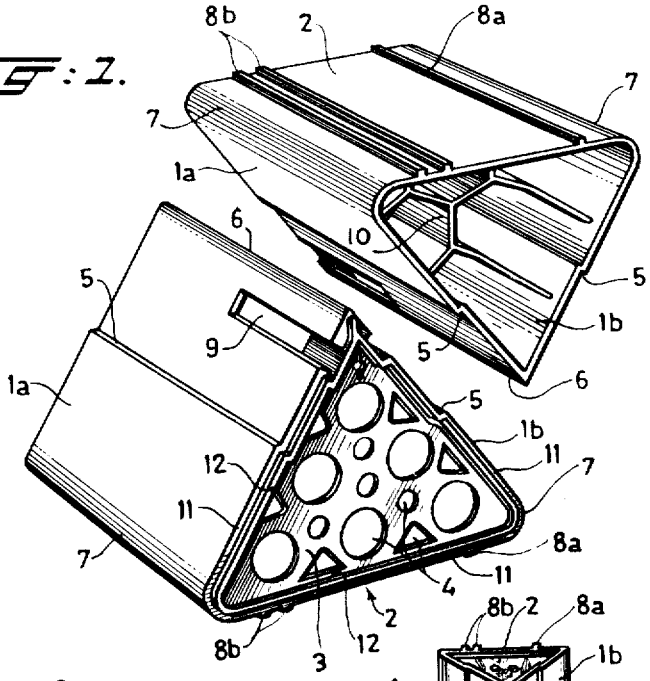
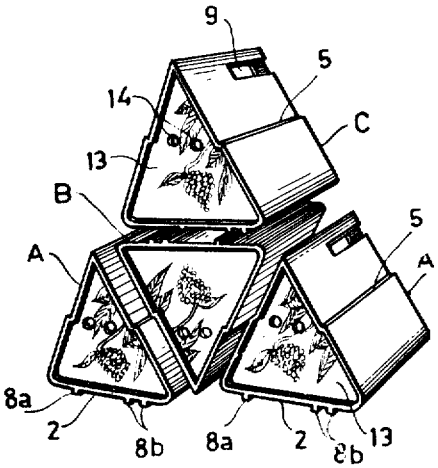
Fig: 2.
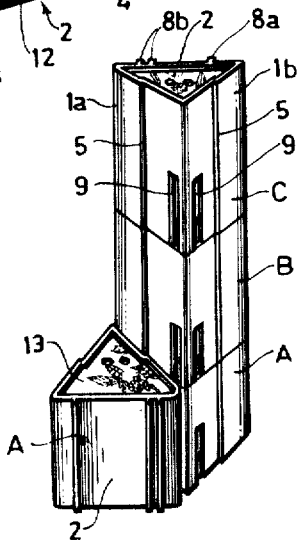
Fig: 3.

NONDEFORMABLE CONTAINER

BACKGROUND OF THE INVENTION

The invention relates to a nondeformable container, having a bottom part and side walls with thereinbetween a partition for a number of objects, in particular to a container for wine bottles. These containers are commonly known and are used for storing and transporting a number of bottles.

These containers have the disadvantage that mostly they have to be handled with both hands, the said containers being provided for that aim with handles on the opposite side walls. Another disadvantage of these containers is that they can be stacked bottom-down only, which, for example when stacking up containers containing wine bottles, is undesirable because in such a case it is better to be able to stack these containers on their sides.

SUMMARY OF THE INVENTION

It is the aim of the invention to provide a container which is easy to handle as packing means and easy to transport with one hand by the consumer.

Another object of the invention is to provide a container which can be stacked in an upward position and in a position such that the bottles are maintained in a horizontal state.

This object is attained, according to the invention, by a container having a bottom part and side walls with thereinbetween a partition for a number of objects, in particular bottles, wherein the side walls of the container form a trilateral prism.

The trilateral prism form affords stacking of the containers both with the bottoms down and on their sides, since the trilateral prisms fittingly match each other.

In order to prevent a wedge effect from occurring on the side as a result of the triangular shape, when stacking up the containers, the container according to the invention has been so designed that two adjoining side walls are provided, at least over a portion of the height of these walls, with a step directed towards the angle between said side walls. When putting them on their sides, in which case the containers are stacked alternately with their base sides down and with their base sides up, the steps engaging each other, only perpendicular normal forces arise in the area where the steps are located.

According to a preferred embodiment of the invention, the side walls of the containers provided with a step have an opening in the vicinity of the angle closed in by said walls, and the openings in both side walls thus directly face one another. This results in some sort of handle which facilitates handling by the consumer.

According to the invention, it is also possible to vertically stack the containers, the bottoms being turned downwards, for instance during transport by trucks. According to the invention this is enabled in accordance with another particular feature of the invention, whereby in the vicinity of one end plane of the trilateral prism the side walls contain a rabbet and the collar thus formed fits into the interior of the space enclosed by the side walls at the other end plane of the trilateral prism.

SURVEY OF THE DRAWINGS

FIG. 1 is a perspective view of two containers turned upside down with respect to one another, the bottom parts of the containers being vertically disposed;

FIG. 2 is a perspective view of the stacking of these containers, the side walls being disposed one upon the other and FIG. 3 is a perspective view of stacking of containers with the bottoms down.

DESCRIPTION OF PREFERRED EMBODIMENT

In the drawing the containers are shown in the form of a trilateral prism having two side walls 1*a* and 1*b* and a third side wall 2 as well as a bottom part 3. As frequently occurs in the case of nondeformable containers the bottom is provided with openings 4.

As regards the side walls 1*a* and 1*b* it is to be noted that they are provided with a step 5. The step is directed towards the angle 6 closed in by the side walls 1*a* and 1*b*. The angle 6 has a small rounding contrary to the angles 7 between the side walls 1*a*, 1*b* and the side wall 2 which have a relatively large rounding.

The side wall 2 is provided with protruding cams or ribs which, with respect to the centre line of the side wall, are divided into two groups, that is, into an odd number on the one side of the centre line and an even number on the other side of the centre line. These groups are referenced 8*a* and 8*b*, respectively. The side walls 1*a* and 1*b* are, furthermore, provided with an opening 9 in the vicinity of the angle for carrying the container with one hand. The opening 9 in the side wall 1*a* then lies directly opposite the opening in the side wall 1*b*, In addition, the interior is provided, in a known manner, with a compartment subdivided by means of partitions in the form of a honey comb 10. Since, in the exemplified embodiment, the container is designed to receive six wine bottles, the honey comb need not fully extend to the open end of the container, as only the wide portion of the bottle is able to fit into the sections formed by a honey comb partition and the bottle necks are allowed to protrude freely into the clear space present. For this reason also, the handle formed by the openings 9 is located in the vicinity of the bottom. since a holder when filled, is heavier near the bottom that it is near the open end. Moreover, the side walls are provided with a rabbet 11 (FIG. 1) close to one end plane of the trilateral prism formed by the side walls 1*a*, 1*b* and 2, and the thus resulting collar 12 fits into the interior of the space enclosed by the side walls at the other end plane of the trilateral prism.

Stacking the containers of their sides proceeds as follows. Initially, the containers A are placed on the floor with their side wall 2 down. Subsequently, in the resultant spaces thereinbetween, the containers B are positioned with their bottom part 2 disposed upwardly. Thus, there arises on top of the container A and B a flat surface upon which the containers C may be placed. In order to prevent the containers C from sliding sideways, a rib 8*a* of a container C fits in between two ribs 8*b* of a container B, as is clearly shown in FIG. 2.

As illustrated in FIG. 3, the containers of the invention also affords a stacking in a different arrangement. In this case the containers B are placed upon the containers A, whose bottoms are facing down, the containers C in turn being placed upon the former. The collar 12 produced by the rabbet 11 then fits into the open end of the containers already disposed thereunder. It is evident that in this manner the containers are prevented from sliding in relation to each other. In addition, the steps 5 of the neighbouring containers again fit into one another, so that a relatively great stability can be obtained in the transverse direction as well. The open end of the container may be provided with cover plate 13 which is preferably provided with one or several openings 14 enabling a removal of the cover plate from the interior of the container. If the cover plate 3 should be sturdy enough, the openings 14 may also facilitate handling when stacking the containers. Such a cover plate may also be used at the bottom end to enhance the physical appearance of the holders when they are stacked with their side walls upon each other. As clearly shown in FIG. 2 the cover plates may be decorative.

In a very preferred embodiment the edges of the openings 9 do not extend perpendicular to the bottom but the edges extend obliquely with respect to the bottom in such a way that the extension of the center line of an opening 9 intersects the corner line 6 or the extension thereof at a point upward from the inner end of the opening 9 towards the upper end of the container. In this way there is no risk that the bottles as present in a container slide from the container and drop on the ground.

What is claimed is:

1. A nondeformable container comprising a bottom wall and first, second and third side walls with a partition thereinbetween for a plurality of bottles, said side walls of the container forming a trilateral prism, with said bottom wall at one end of said prism, the adjoining first and second side walls each including a step dividing each of said first and second side walls into two parts of which one part is recessed toward the interior of said container with respect to the other part, said two parts of each of said first and second side walls defining first stacking means for side-by-side mating with one of a first and second side wall of a like container, and said third wall is provided with protruding ribs defining second stacking means for side-by-side mating with a third wall of a like container.

2. A container as claimed in claim 1, wherein said first and second side walls each have an opening in the vicinity of the prism corner joining said first and second side walls, and the openings in said first and second side walls are located directly opposite each other for carrying the container by hand.

3. A container as claimed in claim 2, wherein said ribs on said third wall are divided into two groups by the center line of said third wall such that an even number of ribs are provided on the one side of the center line and an odd number on the other side.

4. A container as claimed in claim 3, wherein said odd number is one and said even number is two, said two ribs being spaced by a groove therebetween, said groove and one rib being spaced on opposite sides of said center line by an equal distance, such that rib-in-groove engagement is obtainable between the third walls of an upright container supported atop an inverted container only with the bottom walls of both containers facing in the same direction.

5. A container as claimed in claim 1, wherein at one end plane of the trilateral prism, the side walls are provided with a rabbet and the collar left by the rabbet fits in nesting relation into the interior of the space enclosed by the side walls at the other end plane of another said trilateral prism.

6. A container as claimed in claim 1, wherein said steps and ribs extend substantially the full length of said trilateral prism shaped container, said step on each of said first and second side walls being located substantially at the center of its corresponding said side wall and facing toward the corner joining said first and second side walls.

7. A container as claimed in claim 1, wherein said bottom wall is recessed within said trilateral prism shaped container at said one end thereof, said one end being the bottom end of said container, said partition having walls extending between and interconnecting said side walls only adjacent said bottom end of said container to subdivide the container to receive the bottles.

8. In a system of nondeformable stackable containers of trilateral prism form wherein upright ones of said containers are placeable side-by-side in a row with an inverted one of such containers nested therebetween, such a container comprising first and second side walls and a third wall all extending lengthwise of the container and defining a trilateral prism, and a substantially triangular bottom wall at one end of said container;

said third wall having a single rib extending the length thereof near one side edge thereof and means defining a groove extending the length thereof and correspondingly placed near the other side edge thereof, so that an upright container is stackable third wall to third wall with an inverted corresponding container, with said ribs received in said grooves;

said first and second side walls each having a single support step extending the length thereof and located substantially centrally thereon, each said step facing along the outer surface of said container toward the corner of said prism at which said first and second side walls join and facing away from said third wall, each said step dividing its said side wall into a pair of relatively offset surfaces, so that an inverted container is supported by a step on each side thereof on the opposed corresponding steps of two flanking upright containers;

said first and second side walls and third wall having means adjacent the ends thereof for receiving said bottom wall and a removable cover wall in recessed relation within said container out of interfering relation with said step, rib and groove.

* * * * *